US008704075B2

(12) United States Patent
Gournis

(10) Patent No.: US 8,704,075 B2
(45) Date of Patent: Apr. 22, 2014

(54) GUITAR PICKUP ASSEMBLY

(76) Inventor: Angelo Gournis, Mount Prospect, IL (US)

( * ) Notice: Subject to any disclaimer, the term of this patent is extended or adjusted under 35 U.S.C. 154(b) by 0 days.

(21) Appl. No.: 13/095,379

(22) Filed: Apr. 27, 2011

(65) Prior Publication Data

US 2011/0259180 A1 Oct. 27, 2011

Related U.S. Application Data

(60) Provisional application No. 61/328,235, filed on Apr. 27, 2010.

(51) Int. Cl.
*G10H 1/18* (2006.01)
*G10H 3/12* (2006.01)

(52) U.S. Cl.
USPC ..... 84/742; 84/746

(58) Field of Classification Search
USPC ..... 84/736, 742, 746
See application file for complete search history.

(56) References Cited

U.S. PATENT DOCUMENTS 3,530,224 A * 9/1970 Kushner et al. ..... 84/742
4,480,520 A * 11/1984 Gold ..... 84/735
4,545,278 A * 10/1985 Gagon et al. ..... 84/726
5,136,918 A * 8/1992 Riboloff ..... 84/723
5,311,806 A * 5/1994 Riboloff ..... 84/728
5,557,058 A * 9/1996 Lace ..... 84/735
5,763,808 A * 6/1998 Thomson ..... 84/728
5,780,760 A * 7/1998 Riboloff ..... 84/726
5,866,834 A * 2/1999 Burke et al. ..... 84/622
5,977,474 A * 11/1999 O'Brien ..... 84/735
6,034,316 A * 3/2000 Hoover ..... 84/738
6,791,023 B2 * 9/2004 Nakaya ..... 84/736
7,271,332 B2 * 9/2007 Clark ..... 84/736
7,304,232 B1 * 12/2007 Nicholes ..... 84/741
7,982,125 B2 * 7/2011 Takabayashi et al. ..... 84/731
8,084,681 B2 * 12/2011 Schon ..... 84/746
2008/0034950 A1 * 2/2008 Ambrosino ..... 84/742

* cited by examiner

*Primary Examiner* — Jeffrey Donels

(74) *Attorney, Agent, or Firm* — The Watson I.P. Group, PLC; Jovan N. Jovanovic; Vladan M. Vasiljevic

(57) ABSTRACT

A guitar pickup assembly which would allow a guitar player to blend the sound of two or more pickups smoothly as the player desires via the use of a foot pedal. The guitar pickup assembly includes a guitar separately providing the output from a first pickup and a second pickup separately to an actuator, such as a foot pedal, wherein movement of the foot pedal from one position to another position alters the ratio of the signal from the first pickup and the second pickup.

13 Claims, 3 Drawing Sheets

GUITAR PICKUP ASSEMBLY

CROSS-REFERENCE TO RELATED APPLICATION

The present application claims priority from U.S. Provisional Patent Application Ser. No. 61/328,235 filed Apr. 27, 2010, entitled Guitar Pickup Assembly, the entire specification of which is hereby incorporated by reference in its entirety.

BACKGROUND OF THE DISCLOSURE

1. Field of the Disclosure

The disclosure relates in general to musical instruments, and more particularly, to a guitar pickup assembly. The disclosure is more particularly directed to a system for varying the input from various bridges with a separate actuator while playing.

2. Background Art

The use of guitars in music is ubiquitous. Typically, electric guitars have a pair of pickups which receive signals from the movement of the strings. While certain guitars have more than two pickups, it is often the case that a guitar includes a neck pickup and a second bridge pickup. The neck pickup, as its name suggests, is typically positioned on the guitar body close to the neck. The bridge pickup, as its name suggests, is typically positioned on the guitar body close to the bridge.

Generally, the two pickups are wired to the volume knob (and in certain guitars, the tone knob). Additionally, the two pickups are wired to a switch (typically a toggle switch), that allows for the selection of either of the two pickups, or a combination of the two pickups in a fixed orientation. With certain guitars, an additional selector is provided which can vary the intensity of each of the two pickups. This is generally done with a knob that is attached to a stacked pot or the like.

While the functionality of varying the intensity of the two pickups has been contemplated, typically, the user selects the ratio of the first pickup to the second pickup and then plays the guitar. As the user is playing, to change the ratio of the two signals, the user must stop playing to adjust the knob. This allows for static changes to intensity but does not allow for the user to vary the ratio on the fly.

The ability to change the relative ratio between the first and the second pickup while playing would provide the player with a multitude of different options, options that are currently unavailable and currently not contemplated.

Thus it is therefore an object of the disclosure to provide the player of a guitar the ability to receive signals from each of a plurality of pickups and to vary the ratio between the two pickups so as to vary the manner in which the signals are blended.

It is another object of the disclosure to provide the player of a guitar the ability to alter the ratio of input from each of a plurality of pickups while playing and to continuously vary the same as desired.

It is another object of the disclosure to provide the player of a guitar the ability to utilize a foot pedal to alter the ratio of input from each of a plurality of pickups while playing and to continuously vary the same as desired.

These and other objects will become apparent in light of the specification and claims appended hereto.

SUMMARY OF THE DISCLOSURE

The disclosure is directed to a guitar pickup assembly comprising a guitar, a blending switch, a pickup toggle and a pedal assembly. The guitar includes at least a first pickup and a second pickup. The first pickup has a signal output and the second pickup has a signal output. The blending switch has a first input coupled to the signal output of the first pickup, a second input coupled to the signal output of the second pickup, a first signal output A and a first signal output B selectively couplable to the first input and a second signal output A and a second signal output B selectively couplable to the second input. The output signals are configured so that the first signal output A and the second signal output A are selected as a pair and the first signal output B and the second signal output B are selected as a pair, so that the output A or the output B is selected as a pair.

The pickup toggle has a first input and a second input and an output. The first input coupled to the first signal output B and the second input coupled to the second signal output B. The output is coupled to one of the first signal output A and the second signal output A. The pickup toggle is configured to selectively couple any one of the first input to the output, the second input to the output or the first input and the second input to the output.

The pedal assembly has a blending member and an actuator. The blending member includes a first signal input and a second signal input and a signal output. The first signal input is coupled to the first signal output A and the second signal input coupled to the second signal output A. The blending member is configured to vary the ratio of the first signal to the second signal and to provide that ratio to the signal output thereof. The actuator comprises a pedal member configured to selectively alter the ratio of the blending member.

In a preferred embodiment, the blending switch comprises a DPDT switch.

In another preferred embodiment, the output of the pickup toggle is coupled to the second signal output B.

In a preferred embodiment, the blending member comprises a stacked potentiometer.

Preferably, the guitar is coupled to the pedal assembly by way of a stereo output jack.

In another preferred embodiment, the blending switch and the pickup toggle are positioned on the guitar.

In yet another preferred embodiment, the pedal assembly is positioned on a floor or other base remotely from the guitar, and actuatable by a foot of a user.

In a preferred embodiment, the actuator has a first extreme position and a second extreme position. In the first extreme position, the actuator output is received solely from the first signal input. In the second extreme position, the actuator output is received solely from the second signal input.

In a preferred embodiment, the first pickup comprises one of a neck pickup and a bridge pickup. The second pickup comprises the other of a neck pickup and a bridge pickup.

In another embodiment, the disclosure is directed to a guitar which can be coupled to a pedal assembly of the present disclosure. In such an aspect of the disclosure, a stereo output jack is provided and coupled to the first signal output A and to the second signal output A. The output jack is structurally configured for coupling to a blending member which is configured to blend the first signal output A and the second signal output B.

In yet another aspect of the disclosure, the disclosure is directed to a method of blending signals from a first pickup and a second pickup on a guitar comprising the steps of: providing a pedal assembly having a blending member and an actuator, the blending member includes a first signal input and a second signal input and a signal output, the blending member configured to vary the ratio of the first signal input and the second signal input and to provide same to the signal output, and the actuator configured to control and vary the ratio of the blending member; coupling a signal from the first pickup to the first signal input; coupling a signal from the second pickup to the second signal output; controlling the actuator by a foot of a user to alter the ratio by the blending member of the first signal input and the second signal input; and providing the ratio to the signal output of the pedal assembly.

In an embodiment, the actuator comprises a foot pedal.

In another embodiment, the step of providing further comprises the step coupling the signal output of the pedal assembly to an amplifier.

BRIEF DESCRIPTION OF THE DRAWINGS

The disclosure will now be described with reference to the drawings wherein.

DETAILED DESCRIPTION OF THE DISCLOSURE

Figure 1:
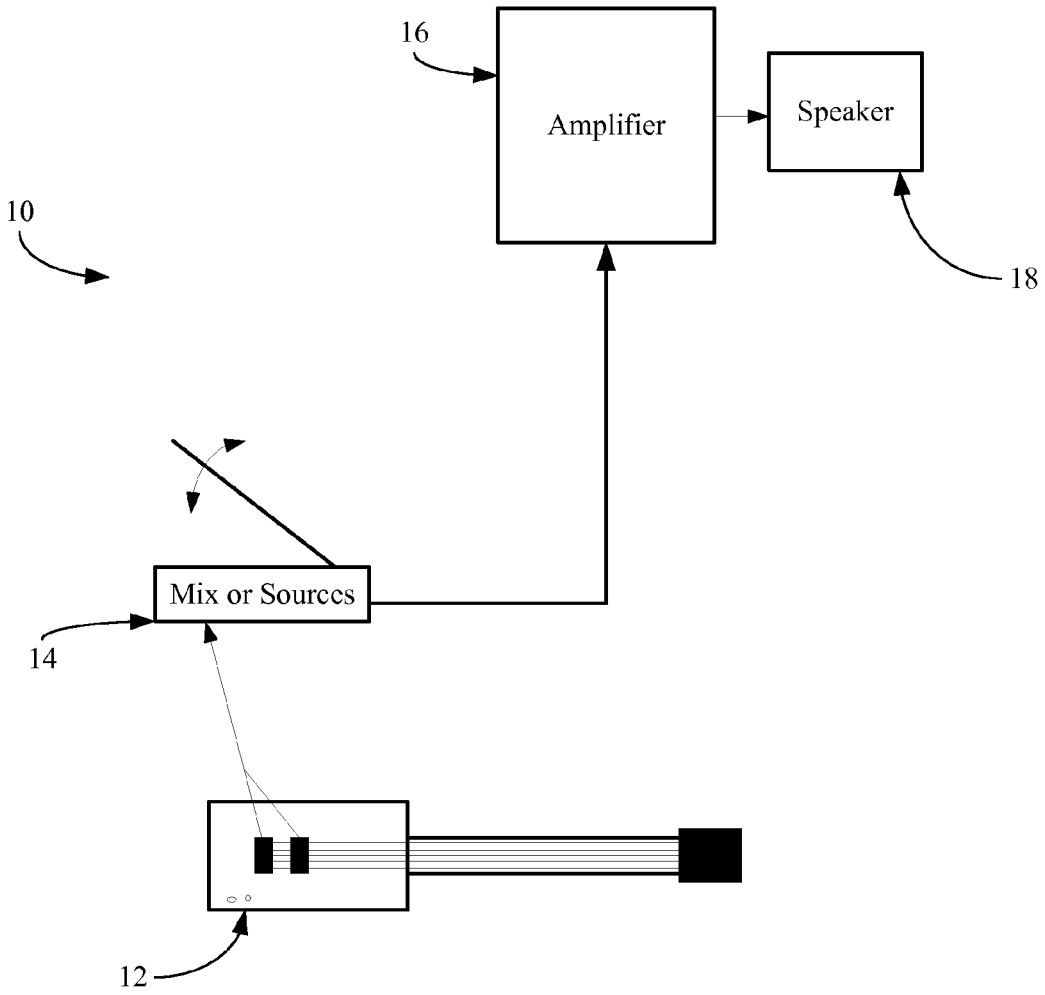
FIG. 1 of the drawings is a schematic representation of the blending of different pickups on a guitar in accordance with the invention.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the system is shown as 10, in a simple form. The system includes guitar 12, pedal assembly 14, amplifier 16 and speaker 18. It will be understood that the system has been simplified, and that a number of different systems are contemplated which alter the amplifier and speaker combinations to provide output and sound in any number of different manners.

Figure 2:
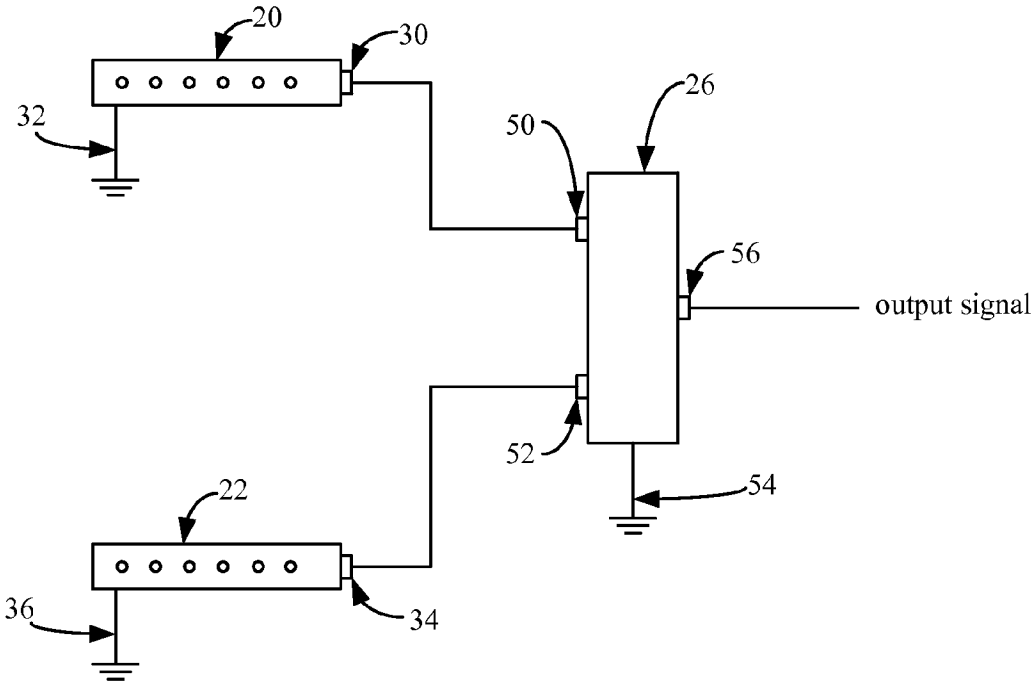
Figure 2 Prior Art
FIG. 2 of the drawings is a schematic representation of a conventional guitar having a first pickup and a second pickup.

The guitar 12, comprises an electric guitar, which is generally known in the art to include at least two pickups, and typically includes at least one volume knob, and a selector switch to pick between the pickups (or a blended signal of both pickups). One conventional system is shown in FIG. 2. As is shown in FIG. 2, the conventional system includes neck pickup 20, bridge pickup 22 and pickup toggle 26. The neck pickup 20 includes signal 30 and ground 32. The bridge pickup 22 includes signal 34 and ground 36. The pickup toggle (which may comprise an analog toggle, pushbutton, or other analog or digital switch) includes first input 50, second input 52, ground 54 and signal output 56. It will be understood that volume control and tone control can be provided for each pickup or for the output signal. As the use of the volume and tone controls is known in the art, these have been omitted from the figure with the understanding that one of skill in the art would understand the positioning and use of the same.

The signal 30 from the neck pickup 20 is directed into the first input 50 of the pickup toggle 26. Similarly, the signal 34 from the bridge pickup 22 is directed to the second input 52 of the pickup toggle 26. The pickup toggle 26 can either couple the first input 50 or the second input 52 to the output 56, or can blend the two signals and couple both of them to the output 56. The output 56, as it will be understood, can be directed to an amplifier which, in turn, amplifies the signal and which can power a speaker or other output device. Typically, a single output signal is provided which comprises the signal from either pickup, or a blend of the two signals in a fixed ratio.

Figure 3:
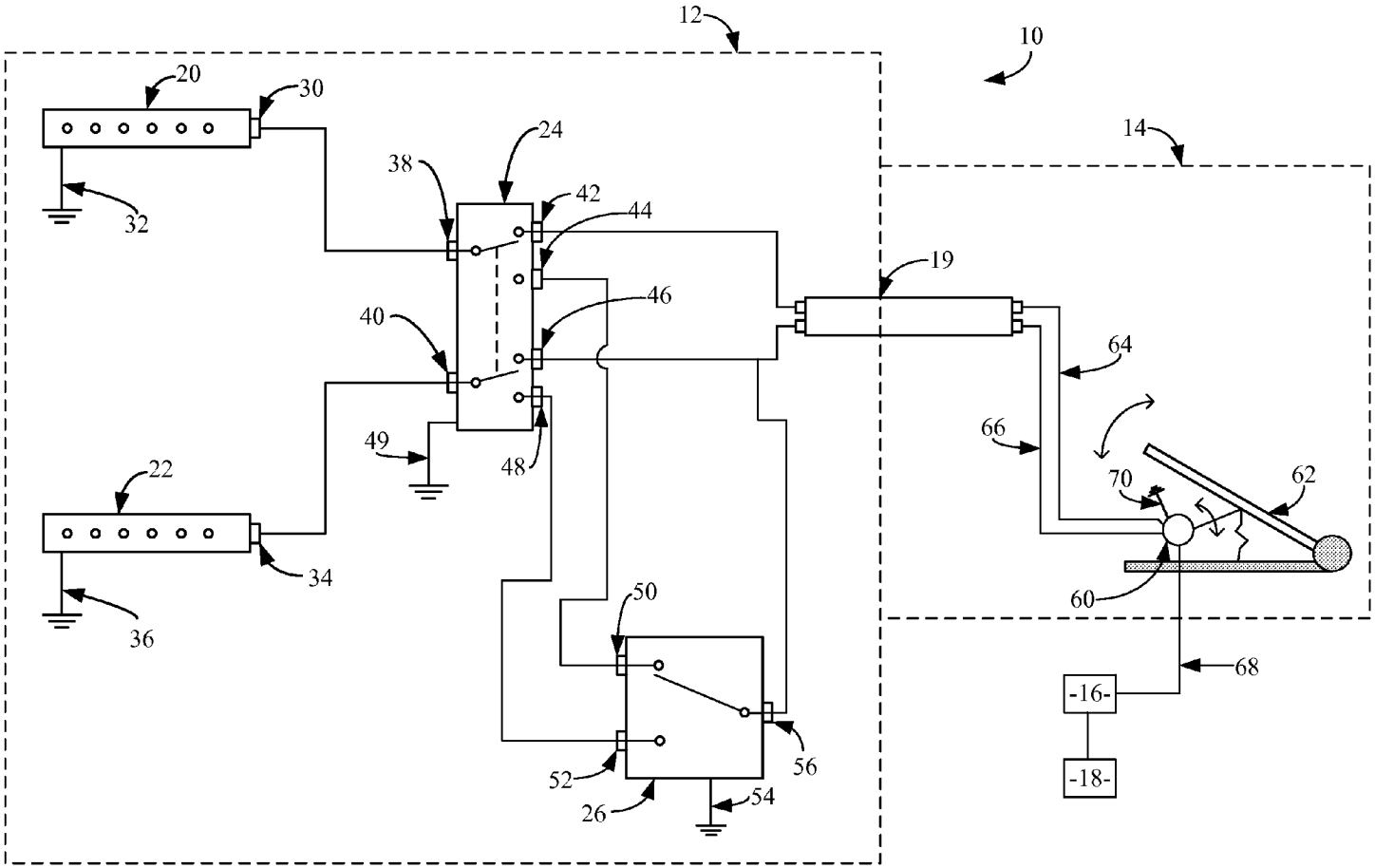
FIG. 3 of the drawings is a schematic representation of a guitar pickup system of the present invention.

With the present disclosure, an additional switch is provided into the system. Such a configuration is shown in FIG. 3. In such a system, blending switch 24 is introduced. The blending switch 24 includes first input 38 and second input 40. Additionally, the blending switch 24 includes first signal output A 42, first signal output B 44, second signal output A 46, second signal output B 48 and ground 49. The blending switch may be a DPDT switch, although the invention is not limited to the use of any particular analog or digital switch. Toggle switches, digital switches, pushbutton switches and the like are each contemplated for use in association with the disclosure.

The signal 30 from neck pickup 20 is coupled to first input 38. The signal 34 from the bridge pickup 22 is coupled to second input 40. The blending switch 24 is configured so that the first input 38 can be selectively coupled to either one of the first signal output A 42 or the first signal output B 44. Additionally, second input 40 can be selectively coupled to either one of the second signal output A 46 or the second signal output B 48.

At the same time the blending switch 24 is configured so that the selection of outputs from the inputs is coupled to each other. For example, the switch has a first position wherein the first input 38 is coupled to first signal output A 42 and the second input 40 is coupled to the second signal output A 46. This is termed the "A" position. The switch has a second position wherein the first input 38 is coupled to the first signal output B 44 and the second input 40 is coupled to the second signal output B 46. This is termed the "B" position.

In the A position, a pair of output signals are provided. First output signal A 42 is the signal 30 from neck pickup 20. Second output signal A is the signal 34 from the bridge pickup 22. These signals are provided to, for example a conventional stereo audio jack 19 (while other output configurations are contemplated).

In the B position, first signal output B 44 is directed to the first input 50 of pickup toggle 26. Additionally, the second signal output B 48 is directed to the second input 52 of pickup toggle 26. The pickup toggle 26, as described above, can provide to output 56 either the signal from first input 50 or second input 52 or a blend of the first and second inputs 50, 52. The output 56 is then coupled to one of the first signal output A 44 and the second signal output A 46.

Thus, it will be understood that in the B position, one of the outputs provided to the stereo output jack will be the output 56 from the pickup toggle 26. The other output will be open and there will be no signal.

The pedal assembly 14 is configured to accept the signals provided by the stereo output jack 19. The pedal assembly 14 includes a blending member (such as a stacked potentiometer 60) and blending member actuator 62 (which may comprise a pedal actuator). The blending member is capable of varying the ratio between two (or more) input signals and provide that blending ratio to the output. As such, in the configuration shown, the blending member 60 includes first signal input 64 which is coupled to the first signal output A 42, second signal input 66 which is coupled to the second signal output A 46. It is also coupled to the output 56 from pickup toggle 26, in the embodiment shown. It will be understood that the output 56, as explained above, can be coupled to either the first signal output A 42 or the second signal output A 46.

The blending member 60 can infinitely vary the ratio between the first input 64 and the second input 66. As such, in one position, the output 68 may comprise solely the signal from the first input 64 or the second input 66, or some combination of both. It will also be understood that the blending member 60 may be configured so that one input signal is provided at at least a first predetermined level. Again, any combination of the two signals is contemplated.

In one embodiment, the system is configured so that the actuator 62 has a first extreme position and a second extreme position. In the first extreme position, the output 68 comprises solely signal from the first input 64. In the second extreme position, the output 68 comprises solely signal from the second input 66. In the middle between the first extreme position and the second extreme position, half of the signal is provided from the first input 64 and half of the signal is provided from the second input 66.

As such, by varying the actuator 62, the player can selectively vary the intensity of music derived from the neck pickup 20 or from the bridge pickup 22. As the actuator 62 is actuated by something other than the player's hands, the player can vary the bridge from which the signal is provided while keeping his or her hands on the guitar and continuously while playing.

As an interesting aside, due to the configuration of the particular actuator and system, in the B position, the actuator functions as, essentially a volume control for the selected pickup (i.e., a volume control for the output 56). Specifically, in such a position, the input 50 is coupled to first signal output B 44 which is open. As such, when the open signal is blended (essentially no signal at all), the greater the bias toward the open signal, the less intensity of the signal from input 52. In turn, the intensity of the signal (i.e. volume) by the sole input with a signal (input 52) is reduced.

It will be understood that in some embodiments, the pickup toggle 26 can be removed and the signal output 30 and the signal output 34 are directed to the stereo output jack 19, directly. Such a configuration does not allow for conventional usage with switch control. One advantage of the system shown in FIG. 2 is that in one position of blending switch 24, the player uses the guitar as conventionally utilized, and can use the pedal assembly 14 as a volume control.

The system explained above, allows a guitar player to blend the sound of two or more pickups smoothly as the player desires via the use of a foot pedal. The blending of sound would depend on the position of the foot pedal at the player's discretion.

As explained above, and without limitation, if the pedal were in the furthest "up" position, the output of one pickup would only be heard. If it were placed "halfway" position, the pedal would blend the outputs of both pickups equally and if in the furthest down position only the second pickup would be heard. The idea being that the position of the pedal would determine the proportion of one pickup's output to the other.

Depending on the design of the guitar with regard to volume controls, if the pickups have separate volume controls as opposed to one master volume, this would give the player an even wider variety of options with this system.

Amongst other advantages, advantages of the disclosed system include, but are not limited to: 1) To free the guitar player's picking hand to transition between pickup sounds without interrupting his playing, 2) To be able to choose the blend between pickups smoothly eliminating the need to choose between discreet settings with a traditional switch. An analogy to this would be a "wa-wa" pedal that changes it's sound smoothly with the movement of the pedal. Of course, unlike such a pedal, the possibilities and the modes of music are completely unrelated.

From a theoretical standpoint, unlike the "wa-wa" pedal that just modifies the sound of one signal, this pedal would have to take multiple signals and combine them according to the position of the pedal. This would obviously require an output design that begins inside the guitar to separate the pickup outputs and a pedal design as well.

It will be understood that new guitar designs could be configured to match up with the pedal, or current guitars could be modified in accordance with the invention.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A guitar pickup assembly comprising:

a guitar having at least a first pickup and a second pickup, the first pickup having a signal output and the second pickup having a signal output;

a blending switch having a first input coupled to the signal output of the first pickup, a second input coupled to the signal output of the second pickup, a first signal output A and a first signal output B selectively couplable to the first input and a second signal output A and a second signal output B selectively couplable to the second input, wherein the output signals are configured so that the first signal output A and the second signal output A are selected as a pair and the first signal output B and the second signal output B are selected as a pair, so that the output A or the output B is selected as a pair;

a pickup toggle having a first input and a second input and an output, the first input coupled to the first signal output B and the second input coupled to the second signal output B, and the output coupled to one of the first signal output A and the second signal output A, the pickup toggle being configured to selectively couple any one of the first input to the output, the second input to the output or the first input and the second input to the output; and a pedal assembly having a blending member and an actuator, the blending member including a first signal input and a second signal input and a signal output, the first signal input coupled to the first signal output A and the second signal output coupled to the second signal output A, the blending member configured to vary the ratio of the first signal to the second signal and to provide that ratio to the signal output thereof, the actuator comprising a pedal member configured to selectively alter the ratio of the blending member.

2. The guitar pickup assembly of claim 1 wherein the blending switch comprises a DPDT switch.

3. The guitar pickup assembly of claim 1 wherein the output of the pickup toggle is coupled to the second signal output B.

4. The guitar pickup assembly of claim 1 wherein the blending member comprises a stacked potentiometer.

5. The guitar pickup assembly of claim 1 wherein the guitar is coupled to the pedal assembly by way of a stereo output jack.

6. The guitar pickup assembly of claim 1 wherein the blending switch and the pickup toggle are positioned on the guitar.

7. The guitar pickup assembly of claim 6 wherein the pedal assembly is positioned on a floor or other base remotely from the guitar, and actuatable by a foot of a user.

8. The guitar pickup assembly of claim 1 wherein the actuator has a first extreme position and a second extreme position, wherein in the first extreme position, the actuator output is received solely from the first signal input, and wherein in the second extreme position, the actuator output is received solely from the second signal input.

9. The guitar pickup assembly of claim 1 wherein the first pickup comprises one of a neck pickup and a bridge pickup and the second pickup comprises the other of a neck pickup and a bridge pickup.

10. A guitar comprising:

a first pickup and a second pickup, the first pickup having a signal output and the second pickup having a signal output;

a blending switch having a first input coupled to the signal output of the first pickup, a second input coupled to the signal output of the second pickup, a first signal output A and a first signal output B selectively couplable to the first input and a second signal output A and a second signal output B selectively couplable to the second input, wherein the output signals are configured so that the first signal output A and the second signal output A are selected as a pair and the first signal output B and the second signal output B are selected as a pair, so that the output A or the output B is selected as a pair;

a pickup toggle having a first input and a second input and an output, the first input coupled to the first signal output B and the second input coupled to the second signal output B, and the output coupled to one of the first signal output A and the second signal output A, the pickup toggle being configured to selectively couple any one of the first input to the output, the second input to the output or the first input and the second input to the output; and a stereo output jack coupled to the first signal output A and to the second signal output A, structurally configured for coupling to a blending member which is configured to blend the first signal output A and the second signal output B.

11. The guitar pickup assembly of claim 10 wherein the blending switch comprises a DPDT switch.

12. The guitar pickup assembly of claim 10 wherein the output of the pickup toggle is coupled to the second signal output B.

13. The guitar pickup assembly of claim 10 wherein the blending member comprises a stacked potentiometer.

* * * * *